US009644931B1

(12) United States Patent
Cauley, Jr. et al.

(10) Patent No.: US 9,644,931 B1
(45) Date of Patent: May 9, 2017

(54) AMMUNITION CASE PRIMING TOOL

(71) Applicant: Battenfeld Technologies, Inc., Columbia, MO (US)

(72) Inventors: Dennis W. Cauley, Jr., Booneville, MO (US); Michael Cottrell, Columbia, MO (US); Jeremy Harvey, Columbia, MO (US); Glenn He, Columbia, MO (US); Tim Kinney, Columbia, MO (US); Michael Poehlman, Columbia, MO (US); James Tayon, Moberly, MO (US); James Gianladis, Harrisburg, MO (US); Adam J. Birk, Hallsville, MO (US); Matthew Kinamore, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/015,978

(22) Filed: Feb. 4, 2016

(51) Int. Cl.
*F42B 33/04* (2006.01)

(52) U.S. Cl.
CPC ..... *F42B 33/04* (2013.01)

(58) Field of Classification Search
CPC ..... F42B 33/04
USPC ..... 86/32, 36, 37
See application file for complete search history.

(56) References Cited

U.S. PATENT DOCUMENTS 3,555,959 A * 1/1971 Lee ..... F42B 33/04 29/267
3,636,812 A 1/1972 Nuler
4,142,441 A 3/1979 Schaenzer
4,222,305 A * 9/1980 Lee ..... F42B 33/04 86/37
4,542,677 A * 9/1985 Lee ..... F42B 33/04 86/36
5,025,706 A 6/1991 Markle
5,435,223 A * 7/1995 Blodgett ..... F42B 33/04 86/38
5,693,905 A * 12/1997 Blodgett ..... F42B 33/04 86/23
6,260,463 B1 7/2001 Brand et al.
7,806,034 B1 * 10/2010 Lee ..... F42B 33/001 86/37
9,127,919 B2 9/2015 Holland

OTHER PUBLICATIONS

New Hand Priming Tool Offers Adjustable Primer Seating Depth, http://bulletin.accurateshooter.com/2010/08/new-hand-priming-tool-offers-adjustable-primer-seating-depth/, 3 pages, Aug. 27, 2010.

BASE Precision: CPS, http://www.baseprecision.com/products/cps/, 2016 BASE Precision, 4 pages (admitted prior art).

(Continued)

*Primary Examiner* — Bret Hayes

(74) *Attorney, Agent, or Firm* — Senniger Powers LLP

(57) ABSTRACT

Ammunition case priming tool, associated components, and methods of use. The priming tool can be adjustable to adjust a primer seating depth in the ammunition case. An actuation mechanism includes an actuator and a primer driver drivable by the actuator for seating the primer in the case. A stop engages the primer driver to limit travel of a priming head in a priming direction to determine seating depth of the primer. The priming tool can be configured for the priming head to return to a consistent home position.

24 Claims, 9 Drawing Sheets

(56) References Cited

OTHER PUBLICATIONS

Holland Gunsmithing & Shoooters Supply, Holland's Reloading Supplies, http://www.hollandguns.com/, 6 pages (admitted prior art).
K&M Shooting, Priming Tools Kit, https://kmshooting.com/kits-and-accessories/reloading-accessories/complete-kits/priming-tools-kit.html, 2 pages (admitted prior art).
Magnum Metal, http://www.benchrest.com/magnummetal/priming_tool.html (admitted prior art).
Midway USA, Mar. 2000, AD #03100, Lee Auto Prime, 2 pages.
Products for the 21st Century Shooter/Reloader, www.21stcenturyshooting.com, http://www.xxicsi.com/stainless-steel-priming-tool.html (admitted prior art).

* cited by examiner

AMMUNITION CASE PRIMING TOOL

FIELD

The present disclosure generally relates to equipment for loading ammunition, and more particularly to a priming tool for loading a primer in a primer pocket of an ammunition case.

BACKGROUND

Rounds of ammunition usually include a case, a primer in a primer pocket of the case, a propellant in the case, and a bullet seated in a bullet end of the case opposite the primer. The primer has a primary explosive used to ignite the propellant in the case to propel the projectile down a barrel of a firearm. An initial step in manufacturing a round of ammunition or reloading a case is priming the case, i.e., inserting a primer in the primer pocket of the case. There are various types of tools that may be used to assist in inserting a primer in a primer pocket of a case.

SUMMARY

One aspect of the present invention is directed to a hand priming tool for installing a primer in a primer pocket of an ammunition case. The hand priming tool includes a housing and an actuator supported by the housing. A primer driver is supported by the housing and has a priming head. The primer driver is operatively connected to the actuator to drive the priming head with respect to the housing. The primer driver is drivable by the actuator to move the priming head in a priming direction to drive the primer into the primer pocket. A stop has a primer driver engagement surface. The primer driver engagement surface is configured to engage the primer driver to limit movement of the priming head in the priming direction. The stop is adjustable to move the primer driver engagement surface between at least first and second different positions relative to the housing for adjusting a distance the primer driver drives the primer into the primer pocket. The primer driver engagement surface in the first position permits the priming head to move farther in the priming direction than the primer driver engagement surface in the second position.

Another aspect of the present invention is directed to a method of inserting a primer in a primer pocket of an ammunition case using a hand priming tool. The method includes adjusting a stop of the hand priming tool for setting a distance the primer is to be driven into the primer pocket. The method includes moving an actuator of the hand priming tool to drive a priming head of a plunger in a priming direction for driving the primer into the primer pocket. Movement of the priming head in the priming direction is stopped by engaging the plunger with the stop.

Yet another aspect of the present invention is directed to a hand priming tool for installing a primer in a primer pocket of an ammunition case. The hand priming tool includes a housing and an actuator supported by the housing. The housing is sized to be held in a hand of a user. The actuator is configured for actuation by the hand of the hand holding the housing. A primer driver supported by the housing has a priming head. The primer driver is operatively connected to the actuator to drive the priming head with respect to the housing. The primer driver is drivable by the actuator to move the priming head in a priming direction to drive the primer into the primer pocket. A primer seating position adjuster is configured for changing the distance the priming head is movable in the priming direction. The primer seating position adjuster has at least first and second different configurations for adjusting a distance the primer driver drives the primer into the primer pocket. The primer seating position adjuster in the first configuration permits the priming head to move farther in the priming direction than the primer seating position adjuster in the second position. The priming head has a home position. The priming head is drivable by the actuator to move the priming head from the home position in the priming direction to drive the primer into the primer pocket. The priming head is movable in a retracting direction to return to the home position. The home position of the priming head is the same when the primer seating position adjuster is in the first configuration and when the primer seating position adjuster is in the second configuration.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
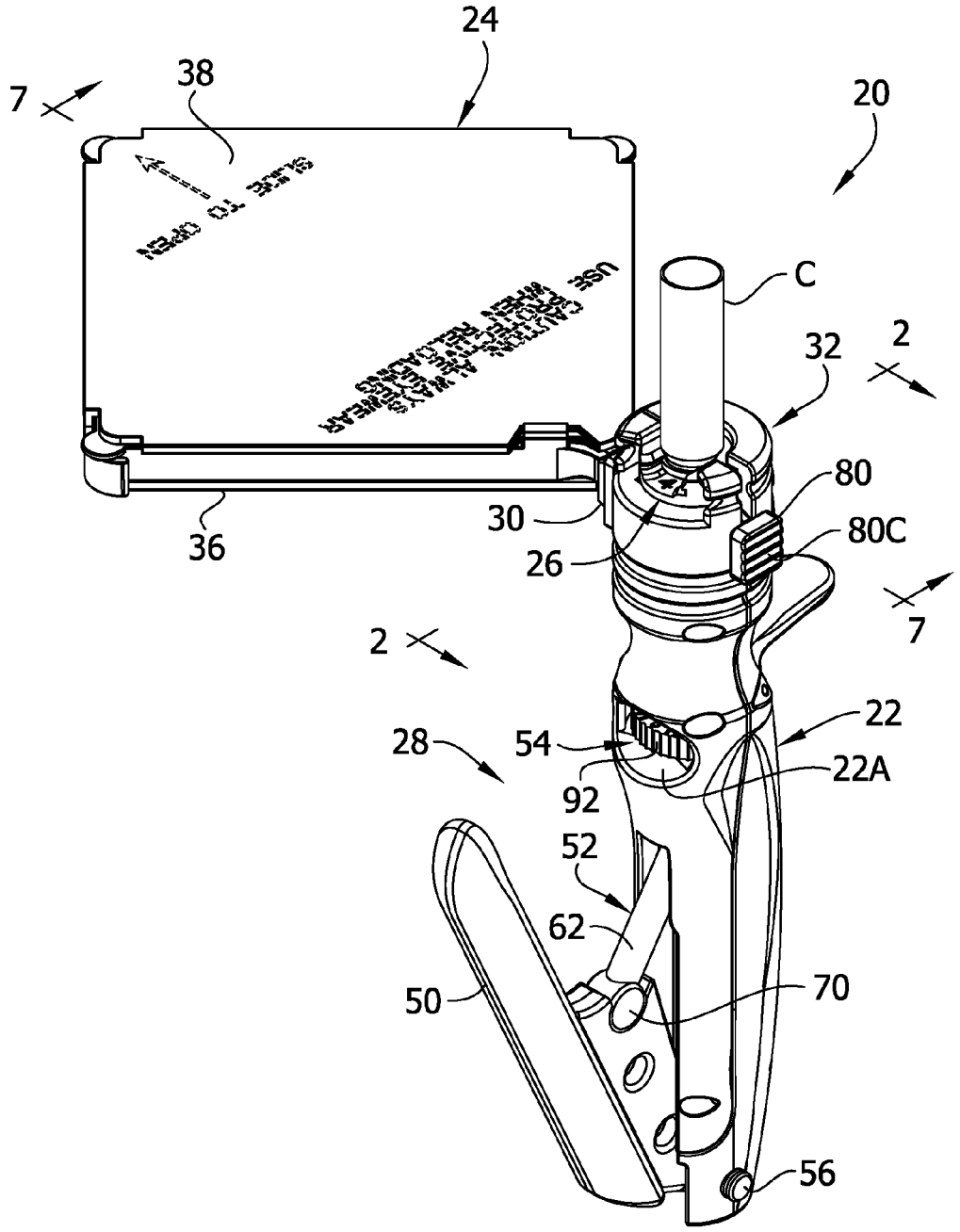
FIG. 1 is a front perspective of an ammunition case priming tool embodying aspects of the present invention.

Referring to FIG. 1, an ammunition case priming tool embodying aspects of the present invention is designated generally by the reference number 20. As will become apparent, the tool is configured for loading primers P into ammunition cases C in a consistent manner providing a precise primer seating depth or position in the ammunition cases (see, FIG. 7). The priming tool 20 is adjustable to provide a desired primer seating depth in an ammunition case C. The adjustable seating depth facilitates use of the priming tool 20 with different types of cases C and primers P. Ammunition cases of different types may have primer pockets PP that have different depths, and different types of primers P may have different sizes. Accordingly, the desired seating depth can change depending on the particular case and primer. The case priming tool 20 permits the seating depth to be adjusted for inserting a primer P in an ammunition case C a desired distance at which the primer is properly seated in the primer pocket, without being inserted too little or too far into the primer pocket.

In the illustrated embodiment, the priming tool 20 is a hand priming tool, meaning the tool is sized and shaped to be held in one hand of a user and actuated by the hand of the user to load a primer P in an ammunition case C, while the tool is supported by the hand of the user. Other configurations can be used without departing from the scope of the present invention.

As shown in FIG. 1, the priming tool 20 generally includes a main body or housing 22, a primer hopper 24, a case holder 26, and an actuation mechanism 28 supported by the housing. As will become apparent, primers P are held in the primer hopper 24 for feeding to the actuation mechanism 28, the case holder 26 holds a case C to be primed, and the actuation mechanism 28 drives a primer P from the primer hopper into the case held in the case holder.

Figure 2:
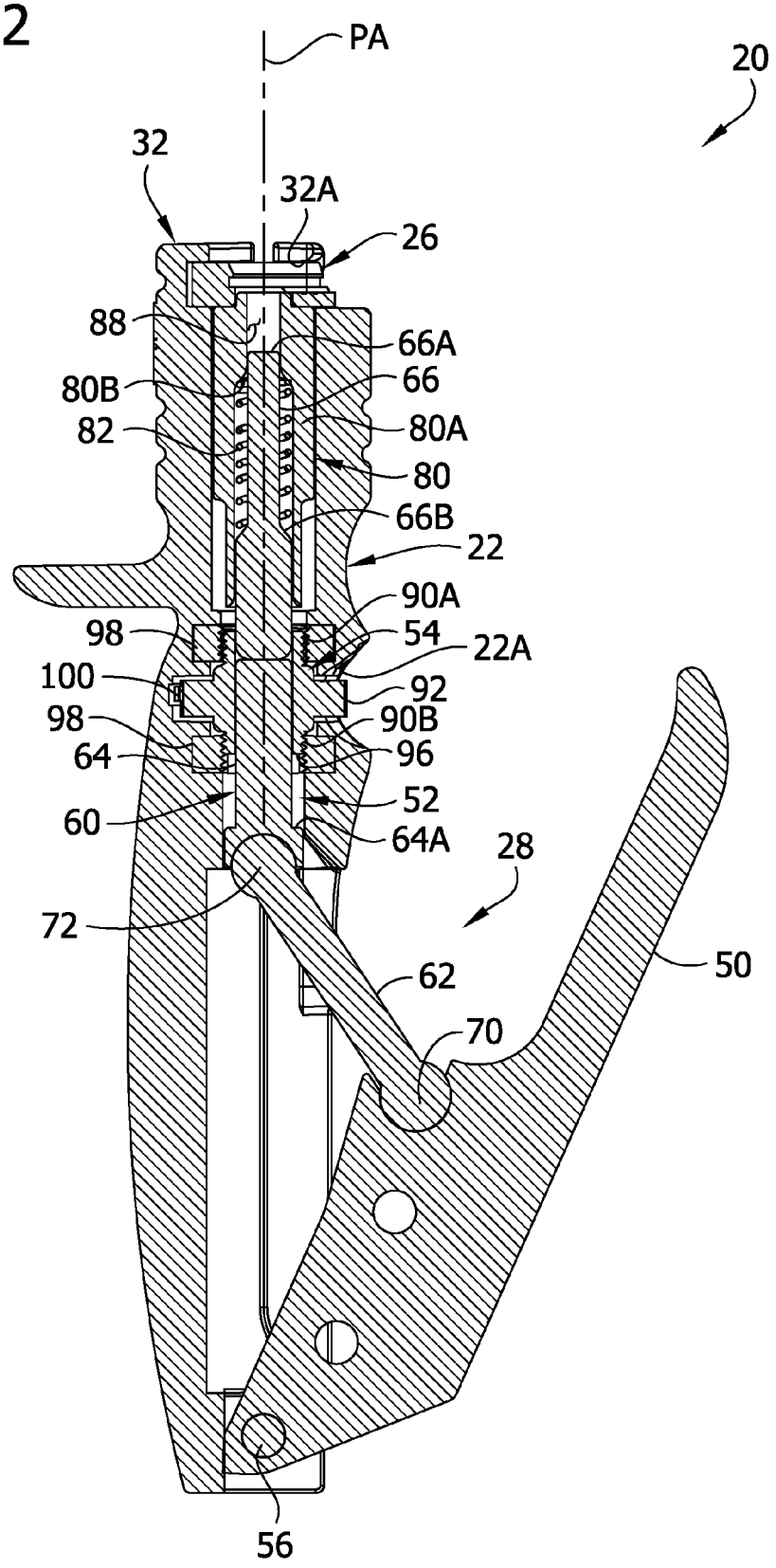
FIG. 2 is section of the ammunition case priming tool taken in a plane including line 2-2 of FIG. 1.
Figure 4:
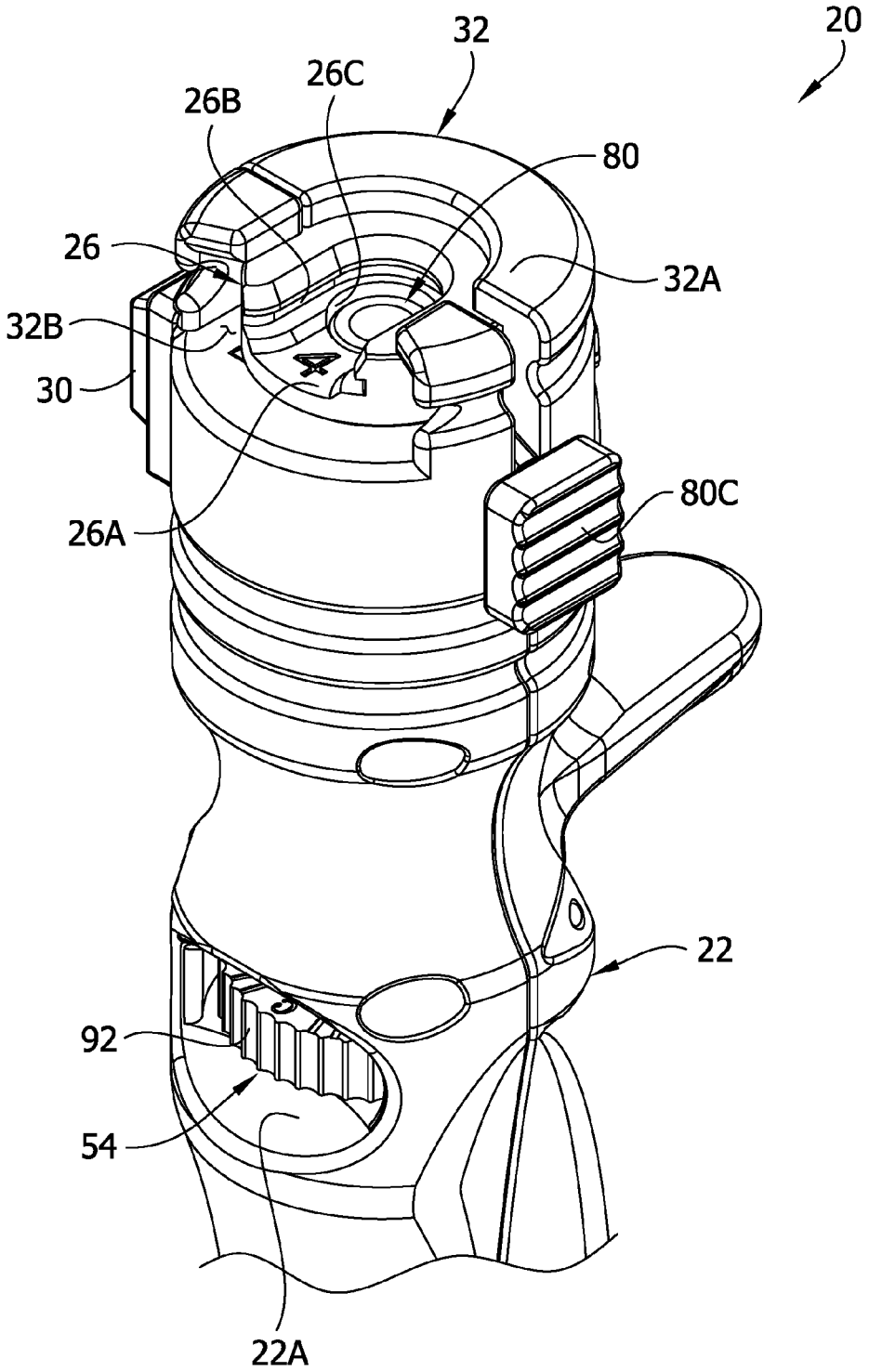
FIG. 4 is an enlarged fragmentary perspective of an upper end of the case priming tool.

The housing 22 is generally elongate and has a handle shape to facilitate gripping of the housing by a hand of the user. An upper end of the housing 22 includes a mount 30 configured for mounting the primer hopper 24 on the housing for feeding primers to the actuation mechanism 28. As shown in FIG. 4, the upper end of the housing 22 also includes a seat 32 for removably receiving the case holder 26. The seat 32 has an upper flange 32A for securing the case holder 26 in the seat and a side opening 32B to permit sliding the case holder into the seat under the flange 32A. As shown in FIG. 2, the housing 22 has an interior below the case holder seat 32 in which components of the actuation mechanism 28 are housed. Other housing configurations can be used without departing from the scope of the present invention.

Figure 7:
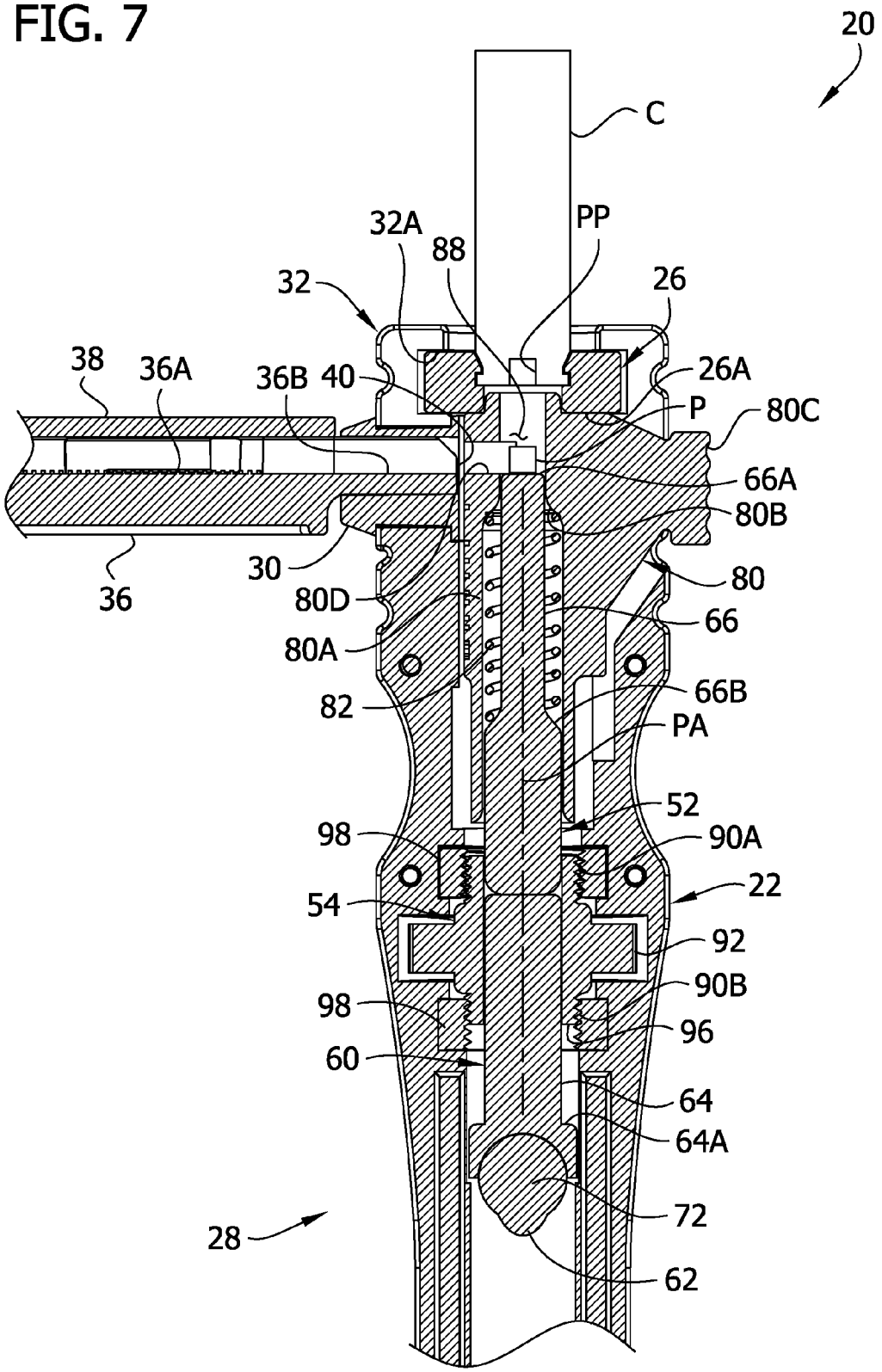
FIG. 7 is an enlarged fragmentary section of the case priming tool taken in a plane including line 7-7 of FIG. 1, an ammunition case and primer being shown on the case priming tool.

The primer hopper 24 includes a primer turning tray 36 and a cover 38. The primer turning tray 36 is configured to receive the primers P and assist in "turning" the primers such that anvil ends of the primers face upward when the primers are on the primer support surface 36A (FIG. 7) of the tray. For example, the primer support surface 36A can include ridges and/or protrusions to assist in turning the primers P. A user can dump primers P onto the tray 36 and gently shake the tray to quickly and conveniently orient the primers having the anvil ends up for loading into ammunition cases C. Referring to FIG. 7, the hopper 24 includes a mouth 40 configured for connection to the mount 30 of the housing 22 by reception of the mouth in the mount. A slide surface 36B of the tray 36 extends to the mouth 40 to permit primers P to slide from the tray 36 out of the mouth. When the hopper 24 is mounted on the housing 22, the hopper is supported by the housing, and the primers P in the hopper are positioned for delivery to the actuation mechanism 28. Other configurations of primer hoppers can be used without departing from the scope of the present invention.

As shown in FIG. 4, the case holder 26 includes a base 26A, a socket 26B for receiving the primer pocket end of the ammunition case, and an opening 26C in the base to permit a primer P to be inserted in a primer pocket PP (FIG. 7) of the case from below the base. It will be appreciated that case holders of various sizes can be used for loading primers in ammunition cases of different sizes. For example, the case holder 26 illustrated in FIG. 4 is configured for holding a case for .223 caliber ammunition. The case holder 26 can be part of a kit including multiple case holders, described in further detail below with reference to FIG. 9.

Figure 3:
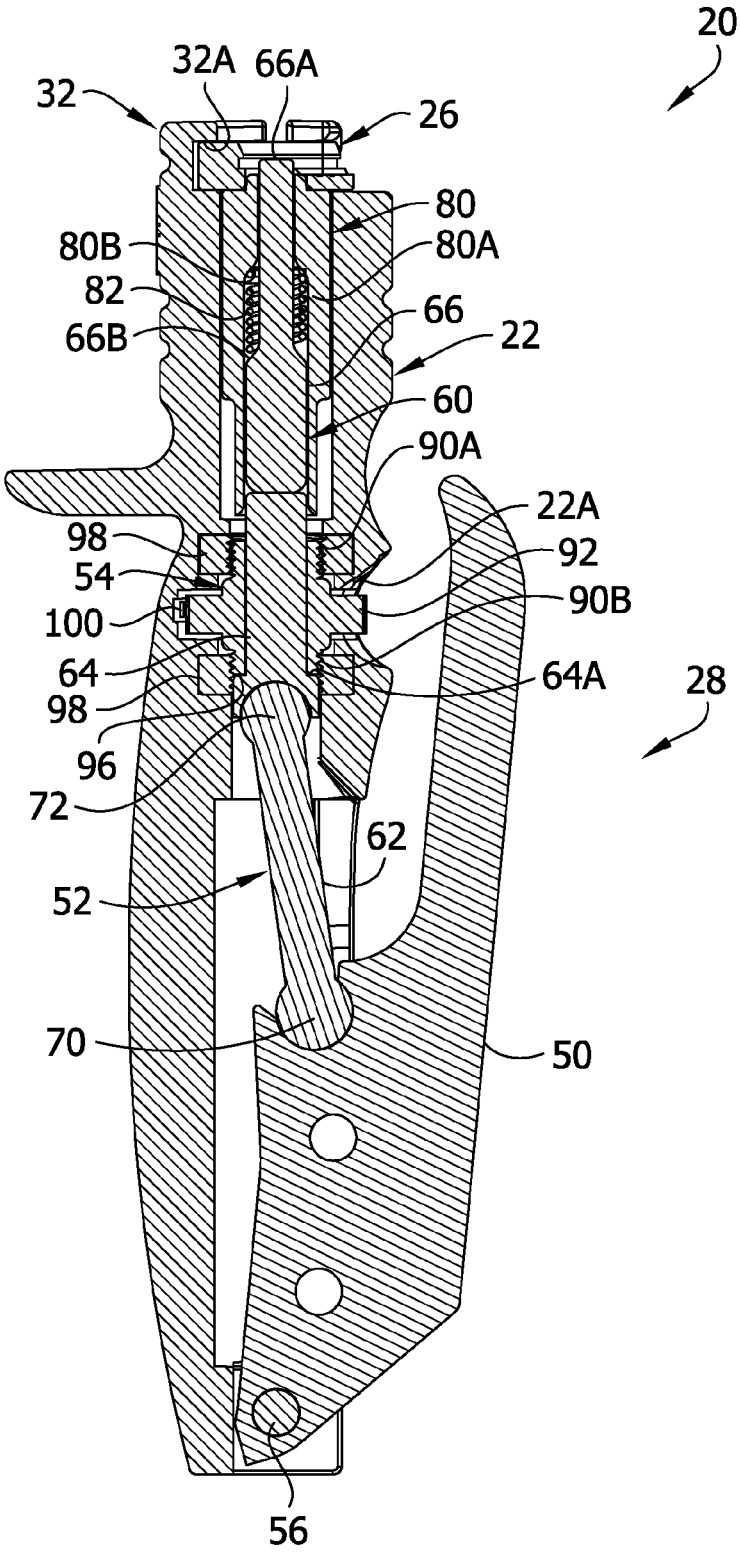
FIG. 3 is a section similar to FIG. 2 but showing a lever of the case priming tool in an actuated position.
Figure 8:
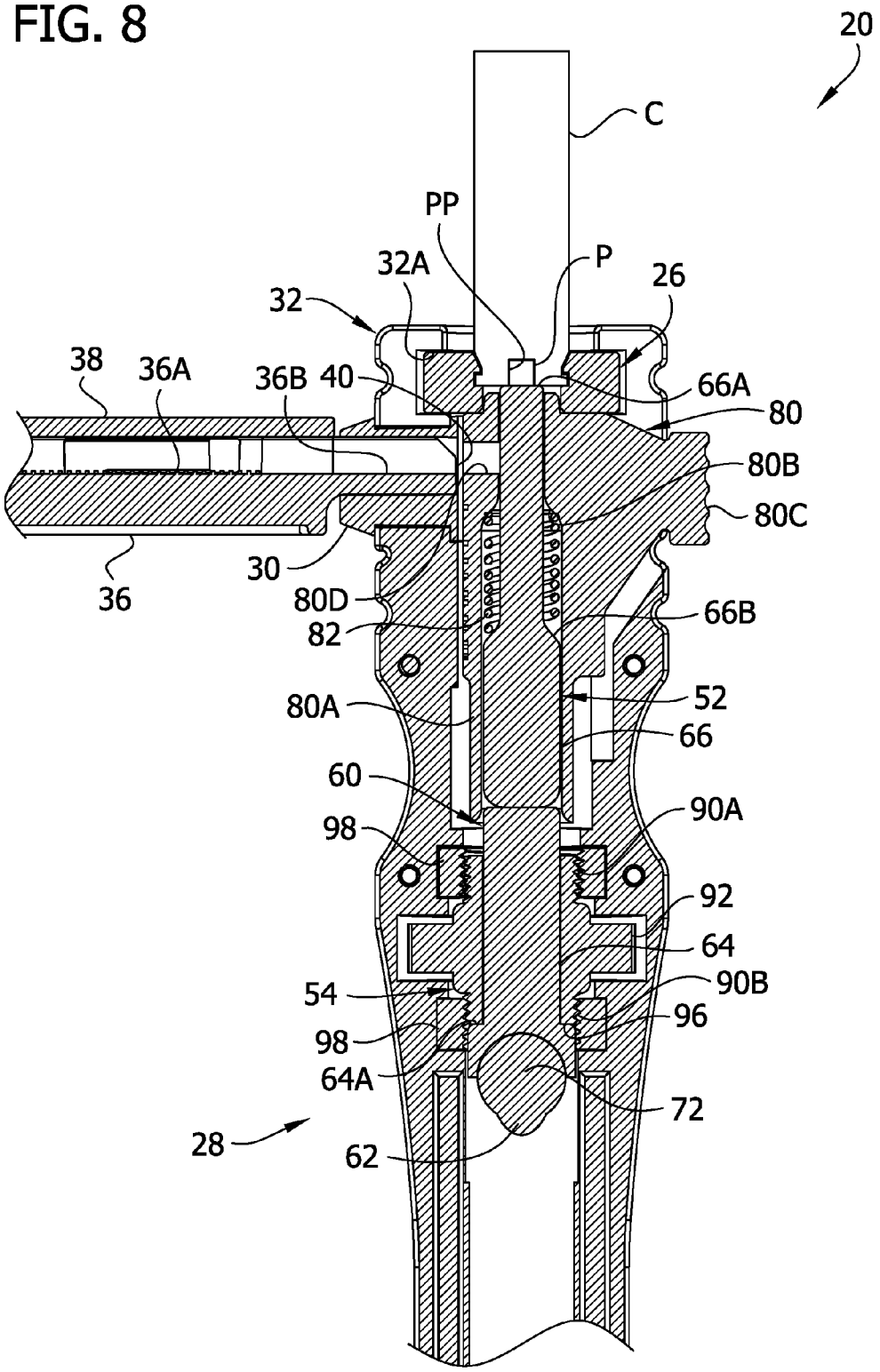
FIG. 8 is an enlarged fragmentary section similar to FIG. 7 but showing the tool having inserted the primer in the ammunition case.

Referring to FIGS. 1, 2, and 7, the actuation mechanism 28 includes an actuator 50, a primer driver 52 operatively connected to the actuator, and a stop (broadly "primer seating position adjuster") 54 for limiting movement of the primer driver. In the illustrated embodiment, the actuator 50 includes a lever having a pivot connection 56 with a lower end of the housing. As shown in FIG. 2, the primer driver 52 includes a plunger 60 and a linkage 62 operatively connecting the plunger to the lever 50. The plunger 60 is movable along a plunging axis PA (FIGS. 2, 7) extending in the plunging direction. In the illustrated embodiment, the plunger 60 includes a lower driving pin 64 and an upper priming pin 66 separate from the driving pin. The pins 64, 66 have longitudinal axes extending along the plunging axis PA. The priming pin 66 has a priming head 66A for engaging and driving the primer P, and the priming pin is drivable by the lever 50 via the linkage 62 and the driving pin 64. In the illustrated embodiment, the linkage 62 includes a bar extending from the lever 50 to the plunger 60. The bar 62 has a first end having a pivot connection 70 with a midsection of the lever 50 and a second opposite end having a pivot connection 72 with the plunger 60 at a lower end of the driving pin 64. The lever 50 is movable from an extended or resting position (FIGS. 2, 7) to a contracted or actuated position (FIGS. 3, 8) for driving the primer driver 52 to drive a primer P into an ammunition case C. In the resting position, the lever 50 extends upward and outward with respect to the housing 22 from the pivot connection 56, and, in the actuated position, a distal end of the lever is closer to the housing and the lever extends generally along a side of the housing. As will be described in further detail below, the adjustable stop 54 controls movement of the priming head 66A in the priming direction to achieve a desired seating position of the primer P in the primer pocket PP of the ammunition case C.

Figure 5:
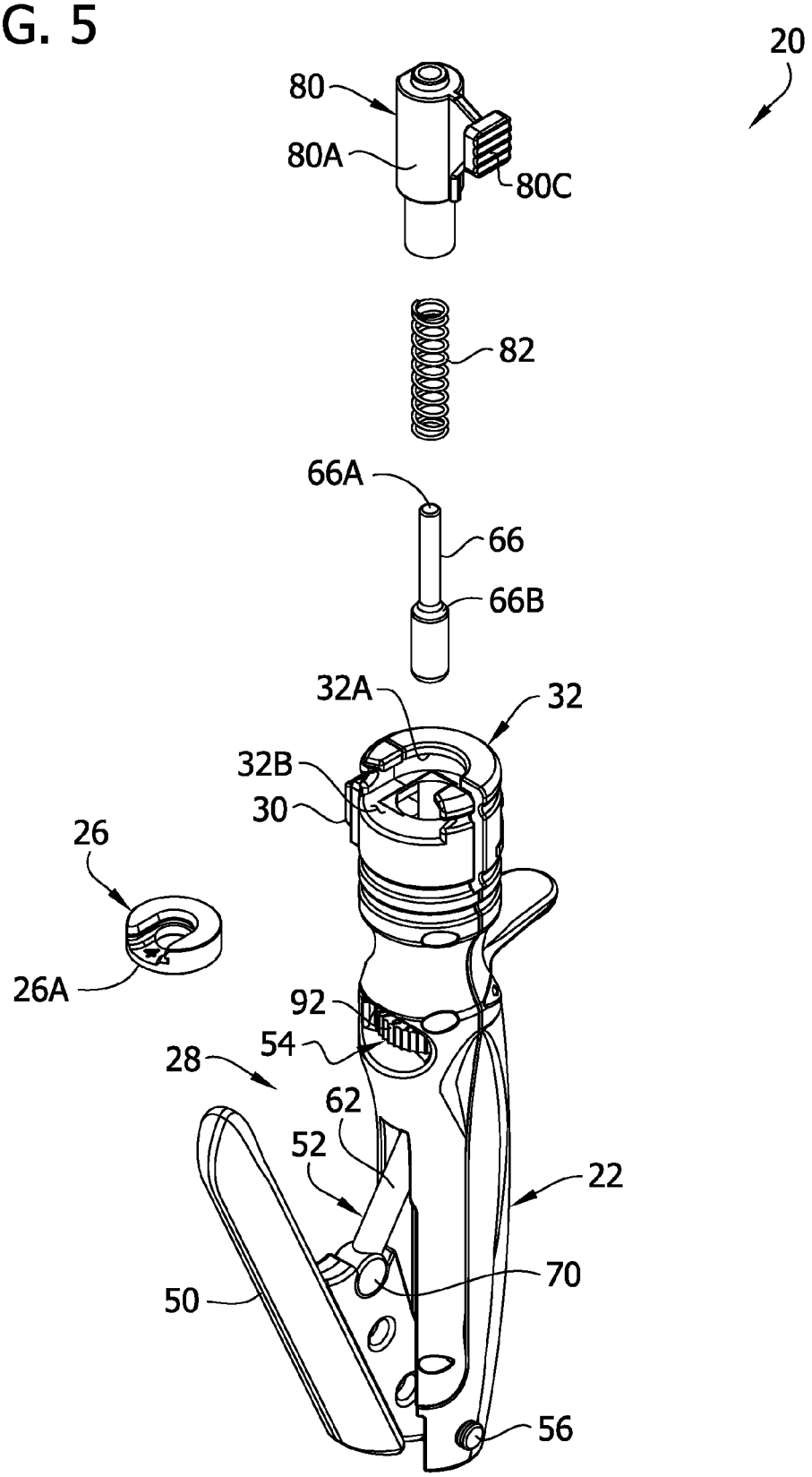
FIG. 5 is a partially exploded front perspective of the case priming tool.

As shown in FIGS. 2 and 7, the actuation mechanism 28 further includes a retainer 80 and a compression spring (broadly "biasing member") 82, which, together with the priming pin 66, are housed in an upper end of the interior of the housing 22. In the illustrated embodiment, the retainer 80 includes a sleeve 80A. The sleeve is sized for receiving the spring 82 and the priming pin 66. Referring to FIG. 5, the spring 82 and priming pin 66 are received in the open bottom end of the sleeve 80A in assembly with each other. The retainer 80, spring 82, and priming pin 66 are placed in the upper end of the housing interior from the top of the housing 22 through the case holder seat 32. The upper end of the spring 82 engages an annular bearing surface 80B at a tapered upper portion of the interior of the sleeve 80A, and the lower end of the spring engages a shoulder 66B of the priming pin, thus biasing the retainer 80 upward and the priming pin downward relative to each other. A ridged pad 80C is connected through a slot in the housing 22 to the sleeve 80A to assist a user in compressing the spring 82 to move the retainer 80 down in the upper end of the housing interior. The pad 80C allows the sleeve 80 to be moved using only one thumb or finger pressed against the pad and driving the pad downward. Moving the retainer 80 downward using the pad 80C provides clearance for the case holder 26 to be moved into the case holder seat 32. When the case holder 23 is in the seat 32 and the user releases the pad 80C, the spring 82 is permitted to extend, and the retainer 80 abuts the case holder base 26A. An upper end of the retainer 80 having a reduced diameter tubular shape becomes seated in the opening 26C of the case holder 26 and releasably retains the case holder in position in the seat 32. A lower end of the priming pin 66 abuts an upper end of the driving pin 64, such that the force of the spring 82 biases the driving pin downward and thus biases the lever 50 to the resting position via the linkage 62. The pad 80C can be used to move the upper end of the retainer 80 downward out of the case holder opening 26C so the case holder 26, and then the retainer 80, spring 82, and priming pin 66, can be removed from the housing 22.

Referring to FIGS. 2 and 7, the retainer 80 defines a primer receiving space 88 below the case holder 26 for receiving a primer from the primer hopper 24. As shown in FIG. 7, the retainer has a primer port 80D in a side of the sleeve 80A permitting a primer P to pass through the side of the sleeve into the primer receiving space 88 from the primer hopper mouth 40. In the resting position of the lever 50, the priming head 66A of the priming pin 66 is in a home position immediately under the primer receiving space. Desirably, the priming head 66A in the home position is located such that a driving surface of the priming head is substantially flush with a bottom surface of the primer port 80D and substantially flush with the slide surface 36B of the tray 36, facilitating a relatively smooth sliding transfer of a primer P from the tray slide surface through the primer port to the priming head. This facilitates transfer of the primer P to the primer receiving space 88 with reduced risk of the primer P tipping or falling over such that it is on its side or otherwise out of proper orientation (i.e., having the anvil end facing up) for loading into the ammunition case C. It will be appreciated that if, for example, the priming head were too low relative to the tray slide surface and/or the bottom surface of the primer port, the primer may have a tendency to tip or fall over when entering the primer receiving space.

Figure 6:
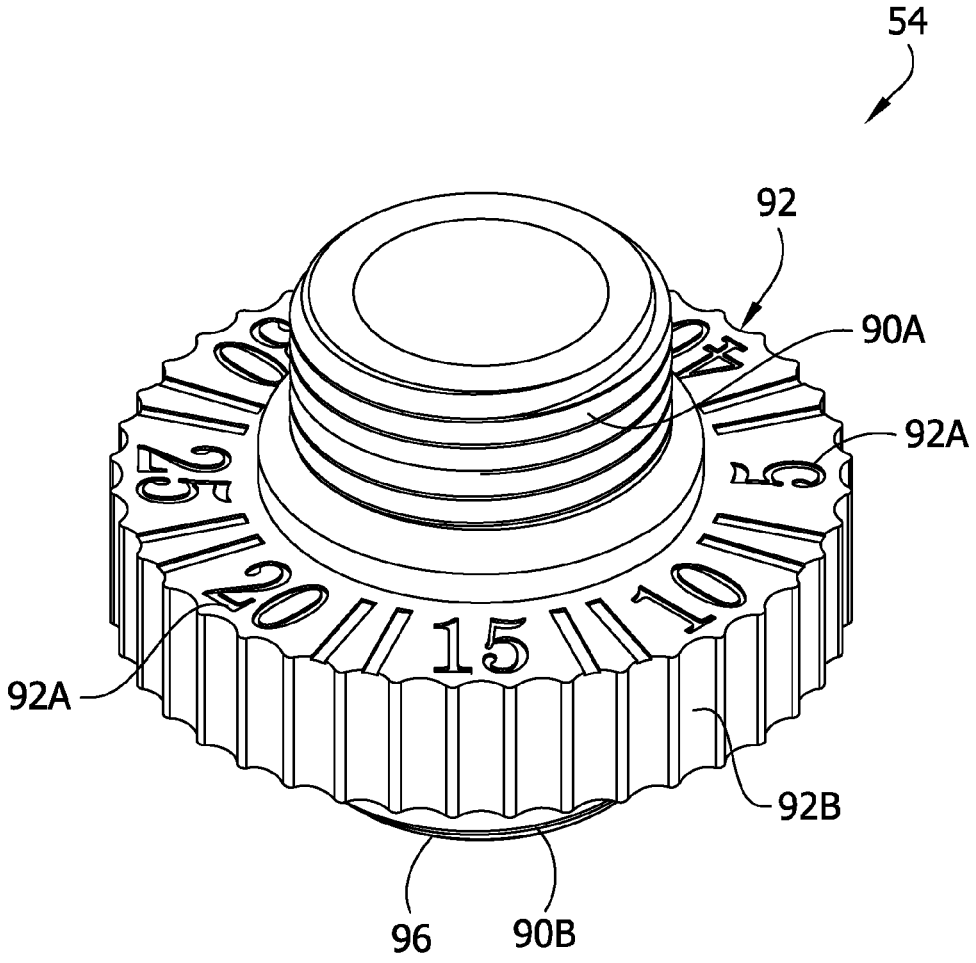
FIG. 6 is an enlarged front perspective of a stop of the case priming tool.

As mentioned above, the stop 54 is adjustable to permit adjustment in seating depth of the primer P in the ammunition case C. As shown in FIG. 6, the stop 54 includes a tube having upper and lower threaded sections 90A, 90B and an actuator in the form of a wheel or dial 92 at a midsection of the tube. In the assembled tool 20, the driving pin 64 extends through the stop 54. The lower end of the stop 54 has a downward facing annular engagement surface (broadly "primer driver engagement surface") 96 for engaging a shoulder 64A on the driving pin 64 to limit movement of the driving pin in the priming direction and thus limit movement of the priming head 66A in that direction (see, FIGS. 7 and 8). The threaded sections 90A, 90B of the stop 54 are received in threaded nuts 98 fixed in the housing 22, such that the stop is supported by a threaded connection with the housing formed by reception of the upper and lower threaded sections in the respective nuts. As shown in FIG. 1, a portion of the dial 92 is exposed through an opening 22A in the side of the housing. The stop 54 is rotatable about the plunging axis PA in a counter-clockwise direction (as viewed from the top) to move the stop toward the case holder 26 and rotatable in a clockwise direction to move the stop away from the case holder. The stop 54 can be rotated to position the engagement surface 96 in a position to engage and stop movement of the driving pin 64 to achieve a desired primer seating position within the ammunition case pocket PP.

Referring again to FIG. 6, a plurality of reference marks 92A are provided on the dial 92 to assist a user in adjusting the stop 54 to provide the desired primer seating depth. In the illustrated embodiment, the reference marks 92A include a series of numbers positioned at increments around an upper surface of the dial 92. The numbers 92A are provided at five unit increments and range from numbers 5 to 40. The dial 92 includes a plurality of notches 92B in an outer circumferential surface of the dial to facilitate the user gripping the dial to turn the dial. The notches 92B also cooperate with a detent 100 (FIG. 2) in the housing 22 to provide indexed rotational movement of the dial 92. The detent 100 engages individual notches 92B as the dial 92 is turned to maintain the dial in a rotated position until sufficient force is applied to overcome the maintaining force of the detent. In the illustrated embodiment, each "click" of the dial 92 (i.e., movement of the dial to engage the next notch with the detent) moves the engagement surface 96 by 0.001 inch. A full rotation provides 0.040 inch of adjustment, and the total travel of the dial 92 provides 0.060 inch adjustment (1.5 rotations of dial). Other ranges of motion are possible within the scope of the present invention. In use, a user can adjust the primer seating depth by trial and error using the reference marks 92A until the desired seating depth is achieved.

Other stops can be used, and the stop 54 can be omitted, without departing from the scope of the present invention. For example, the stop can be configured to adjust in a manner other than illustrated, and can engage a different component of the primer driver for limiting the movement of the priming head in the priming direction.

In use, several primers P are loaded into the primer hopper 24, the hopper is mounted on the housing 22, and a case C to be primed is seated on the case holder 26. The user can orient the tool 20 to tilt the primer hopper 24 such that a primer P slides from the primer hopper into the primer receiving space in the retainer 80. As shown by comparison of FIGS. 7 and 8, when the user actuates the lever 50 by moving it to the actuated position to move the priming head 66A in the priming direction, travel of the priming head in the priming direction is limited by engagement of the shoulder 64A of the driving pin 64 with the engagement surface 96 of the stop 54. Assuming the user has properly adjusted the stop 54, the desired primer seating depth or position is achieved. Upon release of the lever 50, the spring 82 returns the priming head 66A in a retracting direction to the home position (e.g., FIGS. 2, 7), and also causes the lever 50 to return to the resting position (e.g., FIG. 2).

It will be appreciated that the configuration of the stop 54 permits the priming head 66A to return to the same home position no matter the adjusted position of the stop 54. For example, if the stop 54 is adjusted for extended travel of the priming head 66A in the priming direction, or if the stop 54 is adjusted for relatively reduced travel of the priming head in the priming direction, the home position of the priming head is the same. Accordingly, the driving surface of the priming head 66A is consistently positioned in the home position to provide the aforementioned relatively smooth sliding transfer of a primer P from the tray slide surface 36B to the priming head. This arrangement facilitates use of the primer hopper 24, because the arrangement provides reliable feeding of primers in the correct orientation from the hopper to the priming head 66A. It will be appreciated that other adjustment techniques for an actuation mechanism may lead to the home position of a priming head changing based on adjustment for different seating depths.

Figure 9:
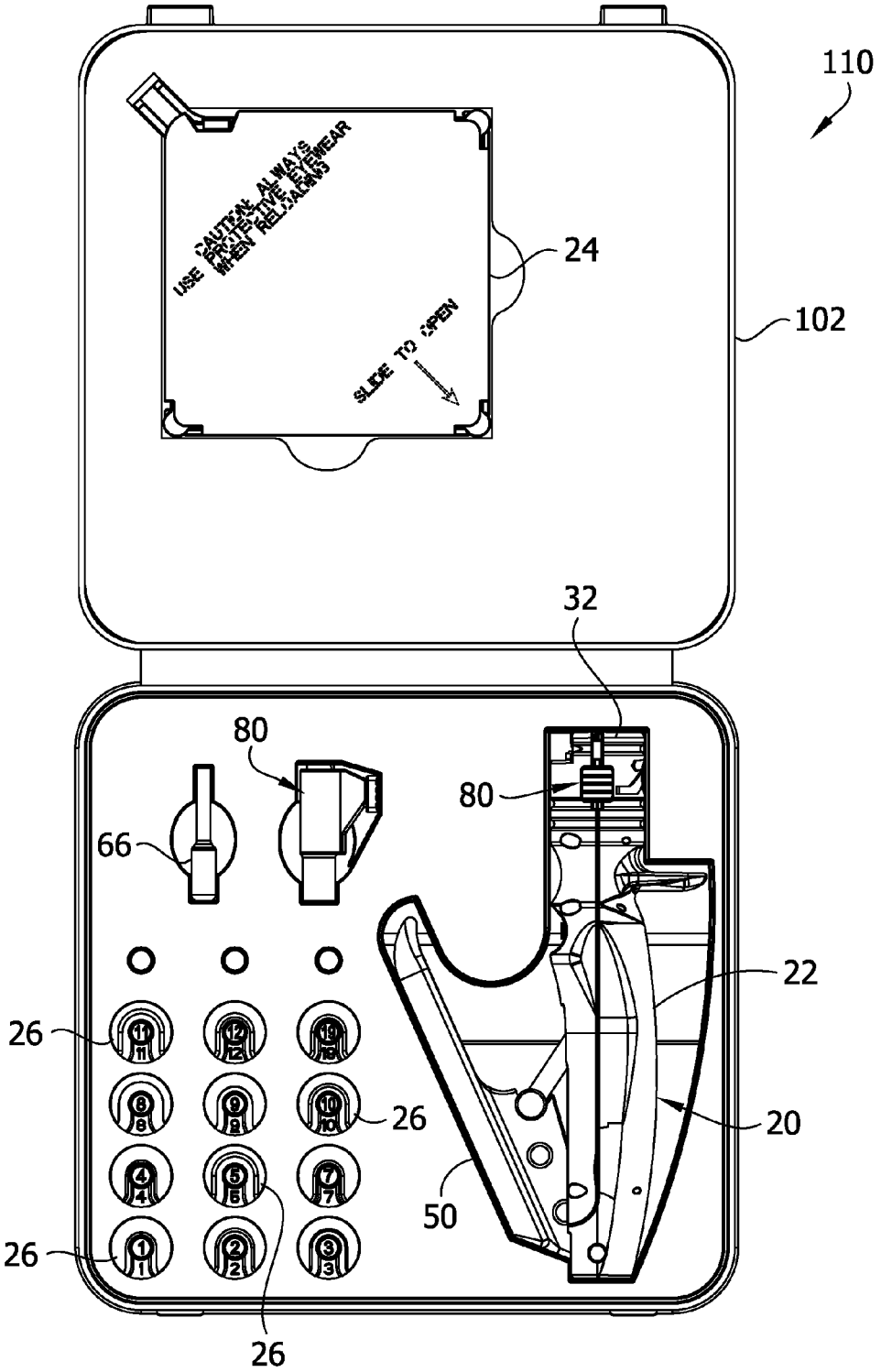
FIG. 9 is a front elevation of a kit including the case priming tool and interchangeable components for loading primers in ammunition cases of various types.

Referring now to FIG. 9, a hand priming tool kit 110 includes a case 102 and several components storable in the case. For example, the kit 110 includes the primer hopper 24, the housing 22, and a plurality of case holders 26 of different sizes for cases of different sizes. The case holders 26 are interchangeable in the seat 32 of the housing and can be installed and removed from the seat in the manner explained above. The kit 110 also includes two priming pins 66 and two retainers 80. A first priming pin 66 is installed in the housing 22, and a second priming pin 66 is shown separate from the housing in the case 102. Likewise, a first retainer 80 is installed in the housing 22, and a second retainer 80 is shown separate from the housing in the case 102. The first priming pin 66 and first retainer 80 are designed to be used together in the housing for installing relatively small primers P (e.g., small rifle primers) in ammunition casings C, and the second priming pin 66 and second retainer 80 are designed to be used together in the housing for installing relatively large primers P (e.g., large rifle primers) in ammunition casings C. For example, the priming head 66A of the first priming pin 66 is smaller than the priming head 66A of the second priming pin 66. In addition, the primer port 80D in the side of the first retainer 80 is smaller than the primer port 80D in the side of the second retainer 80. For example, for cases C for .223 caliber ammunition, the first priming pin 66 and first retainer 80 are used for loading small rifle primers P in the cases. On the other hand, for cases C for .308 caliber ammunition, the second priming pin 66 and second retainer 80 are used for loading large rifle primers P in the cases.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hand priming tool for installing a primer in a primer pocket of an ammunition case, the hand priming tool comprising:

a housing, an actuator supported by the housing, a primer driver supported by the housing and having a priming head, the primer driver being operatively connected to the actuator to drive the priming head with respect to the housing, the primer driver being drivable by the actuator to move the priming head in a priming direction to drive the primer into the primer pocket, a stop having a primer driver engagement surface, the primer driver engagement surface being configured to engage the primer driver to limit movement of the priming head in the priming direction, the stop being adjustable to move the primer driver engagement surface between at least first and second different positions relative to the housing for adjusting a distance the primer driver drives the primer into the primer pocket, the primer driver engagement surface in the first position permitting the priming head to move farther in the priming direction than the primer driver engagement surface in the second position.

2. A hand priming tool as set forth in claim 1, wherein the primer driver includes a plunger, and the primer driver engagement surface is configured to engage the plunger to limit movement of the priming head in the priming direction.

3. A hand priming tool as set forth in claim 2, wherein the plunger is movable along a plunging axis extending in the priming direction to drive the primer in the primer pocket.

4. A hand priming tool as set forth in claim 3, wherein the primer driver includes a linkage operatively connecting the plunger to the actuator, the linkage being pivotally connected to the actuator and being pivotally connected to the plunger.

5. A hand priming tool as set forth in claim 3, wherein the stop is supported by a threaded connection, and the stop is selectively rotatable independent from the housing via the threaded connection to move the primer driver engagement surface between said first and second positions.

6. A hand priming tool as set forth in claim 5, wherein the stop is selectively rotatable about the plunging axis via the threaded connection to move the primer driver engagement surface between said first and second positions.

7. A hand priming tool as set forth in claim 5, wherein the stop includes a plurality of reference marks for setting the distance the primer driver drives the primer into the primer pocket based on a rotated position of the stop.

8. A hand priming tool as set forth in claim 2, wherein the plunger includes a driving pin and a priming pin, the priming pin having the priming head and being drivable by the actuator via the driving pin to move the priming head in the priming direction.

9. A hand priming tool as set forth in claim 8, wherein the primer driver engagement surface is configured to engage the driving pin to limit movement of the priming head in the priming direction.

10. A hand priming tool as set forth in claim 9, wherein the priming pin is removable from the housing independent from the driving pin.

11. A hand priming tool as set forth in claim 1, wherein the priming head has a home position, the priming head being drivable by the actuator to move the priming head from the home position in the priming direction to drive the primer in the primer pocket, the priming head being movable in a retracting direction to return to the home position, the home position of the priming head being the same when the primer driver engagement surface is in the first position and when the primer driver engagement surface is in the second position.

12. A hand priming tool as set forth in claim 1, further comprising a primer hopper configured for holding a plurality of primers for feeding to the primer driver.

13. A hand priming tool as set forth in claim 1, further comprising a case holder configured for holding the ammunition case, the case holder having an socket for receiving the priming head for driving the primer in the primer pocket.

14. A hand priming tool as set forth in claim 13, wherein the case holder is selectively removable from the housing, the case holder being retained on the housing at least in part by a retainer received in said opening for receiving the priming head.

15. A hand priming tool as set forth in claim 14, further comprising a biasing member biasing the retainer in a retaining position in which the retainer is received in said opening, and wherein the retainer is selectively movable against the bias to remove the retainer from said opening.

16. A method of inserting a primer in a primer pocket of an ammunition case using a hand priming tool, the method comprising:

adjusting a stop of an actuation mechanism of the hand priming tool for setting a distance the primer is to be driven into the primer pocket, moving an actuator of the actuation mechanism to drive a priming head of the actuation mechanism in a priming direction for driving the primer into the primer pocket, and stopping movement of the priming head in the priming direction by blocking movement of a component of the actuation mechanism with the stop by moving the component into blocking contact against the stop.

17. A method as set forth in claim 16, wherein driving the priming head comprises driving a plunger of the actuation mechanism along a priming axis extending in the priming direction.

18. A method as set forth in claim 17, wherein moving the component into blocking contact against the stop comprises moving a driving pin of the plunger into blocking contact against the stop, and the method further comprises removing a priming pin of the plunger having the priming head from a housing of the hand priming tool independently from the driving pin.

19. A method as set forth in claim 16, wherein driving the priming head in the priming direction comprises driving the priming head from a home position, the method further comprising returning the priming head to the home position after stopping movement of the priming head, and wherein the home position of the priming head is the same when the stop is adjusted for a first seating depth and when the stop is adjusted for a second seating depth less than the first seating depth.

20. A method as set forth in claim 16 wherein moving the component into blocking contact against the stop comprises moving a primer driver of the actuation mechanism into blocking contact against the stop, the primer driver being operatively connected to the actuator.

21. A method as set forth in claim 20 wherein moving the primer driver into blocking contact against the stop comprises moving a plunger of the primer driver into blocking contact against the stop.

22. A method as set forth in claim 16 wherein the stop is movable to at least four positions for setting the distance the primer is to be driven into the primer pocket, and adjusting the stop comprises moving the stop to one of the at least four positions.

23. A method as set forth in claim 16 further comprising fully supporting a weight of the hand priming tool by holding the hand priming tool with a single human hand, and while fully supporting the weight of the hand priming tool with the single human hand, actuating the hand priming tool using the single human hand to insert the primer in the primer pocket.

24. A hand priming tool for installing a primer in a primer pocket of an ammunition case, the hand priming tool comprising:

a housing sized to be held in a hand of a user, an actuator supported by the housing, the actuator being configured for actuation by the hand holding the housing, a primer driver supported by the housing and having a priming head, the primer driver being operatively connected to the actuator to move the priming head with respect to the housing, the primer driver being drivable by the actuator to move the priming head in a priming direction to drive the primer into the primer pocket, and a primer seating position adjuster configured for changing the distance the priming head is movable in the priming direction, the primer seating position adjuster having at least first and second different configurations for adjusting a distance the primer driver drives the primer into the primer pocket, the primer seating position adjuster in the first configuration permitting the priming head to move farther in the priming direction than the primer seating position adjuster in the second configuration, wherein the priming head has a home position, the priming head being drivable by the actuator to move the priming head from the home position in the priming direction to drive the primer into the primer pocket, the priming head being movable in a retracting direction to return to the home position, the home position of the priming head being the same when the primer seating position adjuster is in the first configuration and when the primer seating position adjuster is in the second configuration.

* * * * *